US008852359B2

(12) United States Patent
Walker et al.

(10) Patent No.: US 8,852,359 B2
(45) **Date of Patent: *Oct. 7, 2014**

(54) METHOD OF BONDING A METAL TO A SUBSTRATE

(75) Inventors: Michael J. Walker, Shelby Township, MI (US); Anil K. Sachdev, Rochester Hills, MI (US); Bob R. Powell, Jr., Birmingham, MI (US); Aihua A. Luo, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 261 days.

This patent is subject to a terminal disclaimer.

(21) Appl. No.: 13/310,110

(22) Filed: Dec. 2, 2011

(65) Prior Publication Data

US 2012/0301734 A1 Nov. 29, 2012

Related U.S. Application Data

(60) Provisional application No. 61/488,995, filed on May 23, 2011.

(51) Int. Cl.

| | |
|---|---|
| ***C23C 22/70*** | (2006.01) |
| ***C23C 22/56*** | (2006.01) |
| *C25D 11/04* | (2006.01) |

(52) U.S. Cl.

USPC ..... 148/276; 148/242; 148/277; 148/284; 148/285; 205/324; 205/333; 427/383.1

(58) Field of Classification Search

USPC ..... 148/242, 276, 277, 284, 285; 205/324, 205/333; 427/383.1

See application file for complete search history.

(56) References Cited

U.S. PATENT DOCUMENTS

| | | | | |
|---|---|---|---|---|
| 4,127,451 | A | 11/1978 | Marceau et al. | |
| 5,131,987 | A | 7/1992 | Nitowski et al. | |
| 5,324,587 | A | 6/1994 | Nitowski et al. | |
| 5,486,283 | A | 1/1996 | Mnich | |
| 5,543,130 | A * | 8/1996 | Tsuno et al. | 428/623 |
| 5,774,336 | A | 6/1998 | Larson | |
| 6,450,396 | B1 | 9/2002 | Krajewski | |
| 6,531,013 | B2 | 3/2003 | Nitowski | |
| 6,852,266 | B2 | 2/2005 | Robinson et al. | |
| 6,887,321 | B2 | 5/2005 | Parkos, Jr. et al. | |
| 8,216,712 | B1 * | 7/2012 | Ramasubramanian et al. | 429/144 |

FOREIGN PATENT DOCUMENTS

| | | |
|---|---|---|
| DE | 19937934 | 2/2001 |
| DE | 102007059771 | 6/2009 |
| DE | 102010018004 | 12/2010 |
| DE | 102011115321 | 4/2012 |

* cited by examiner

*Primary Examiner* — Lois Zheng

(74) *Attorney, Agent, or Firm* — Dierker & Associates, P.C.

(57) ABSTRACT

A method of bonding a metal to a substrate involves forming an oxide layer on a surface of the substrate, and in a molten state, over-casting the metal on the substrate surface. The over-casting drives a reaction at an interface between the over-cast metal and the oxide layer to form another oxide. The other oxide binds the metal to the substrate surface upon solidification of the over-cast metal.

14 Claims, 4 Drawing Sheets

Fig-1F-A

METHOD OF BONDING A METAL TO A SUBSTRATE

CROSS REFERENCE TO RELATED APPLICATION

This application claims the benefit of U.S. Provisional Patent Application Ser. No. 61/488,995 filed May 23, 2011.

TECHNICAL FIELD

The present disclosure relates generally to methods of bonding a metal to a substrate.

BACKGROUND

Many automotive parts are fabricated from, for example, aluminum or steel. In some instances, it may be desirable to replace at least a portion of the aluminum or steel part with a lighter-weight material, such as magnesium. The presence of the lighter-weight material may, in some cases, reduce the overall weight of the automotive part.

SUMMARY

A method of bonding a metal to a substrate is disclosed herein. The method involves forming an oxide layer on a surface of the substrate, and in a molten state, over-casting the metal onto the substrate surface. The over-casting drives a reaction at an interface between the over-cast metal and the oxide layer to form another oxide, where the other oxide binds the metal to the substrate surface upon solidification of the over-cast metal.

BRIEF DESCRIPTION OF THE DRAWINGS

Features and advantages of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

FIGS. 1A through 1D (with or without FIG. 1C) and 1J schematically depict other examples of a method of bonding a metal to a substrate;

FIGS. 1A, 1B, and 1D through 1F schematically depict yet another example of a method of bonding a metal to a substrate;

FIGS. 1A and 1G through 1I schematically depict still another example of a method of bonding a metal to a substrate;

FIG. 1F-A is an enlarged view of a portion of the schematic shown in FIG. 1F;

DETAILED DESCRIPTION

Figures 1A, 1B, 1C, 1D, 1E, 1J:
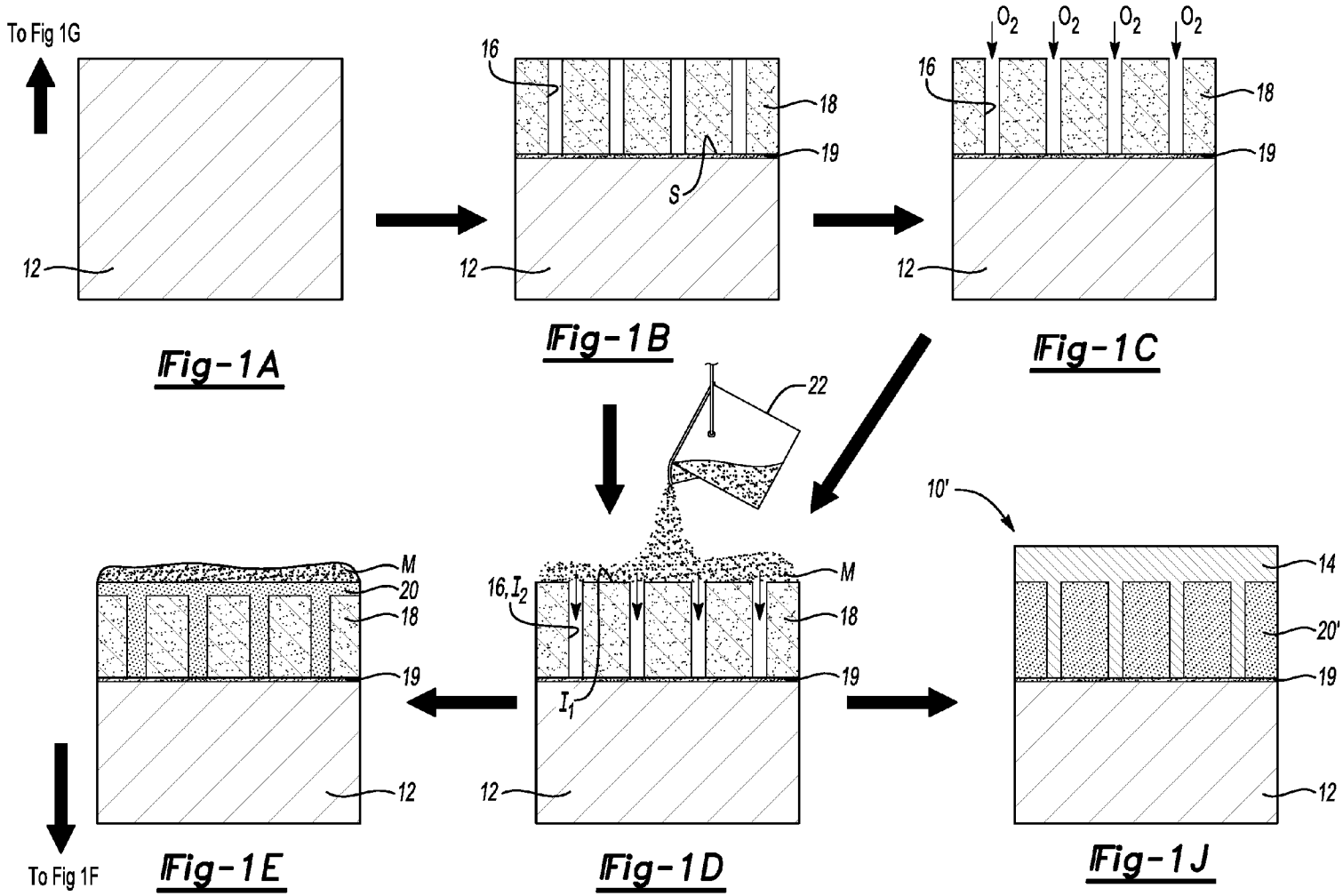
FIGS. 1A through 1F schematically depict one example of a method of bonding a metal to a substrate.

Aluminum and steel may be used to make various automotive parts, at least because these materials have a mechanical strength that contributes to the structural integrity of the part. It has been found that some of the aluminum or steel in a part may be replaced by lighter-weight material(s) (such as, e.g., magnesium). It is believed that the presence of the lighter-weight material(s) may, in some instances, reduce the overall weight of the automotive part.

It has been found that magnesium may be incorporated onto an aluminum or steel part via a casting process, such as a process known as over-casting. It has also been found that, in some instances, the magnesium may not metallurgically bond to the underlying aluminum or steel, at least not to the extent necessary to form a part that is considered to be structurally sound and usable in an automobile. For example, the aluminum may include a dense oxide surface layer (e.g., alumina) formed thereon which, during casting, may prevent magnesium from metallurgically bonding to the aluminum underneath the oxide layer. More specifically, during the casting process, magnesium cannot penetrate the dense oxide layer and bond with the underlying aluminum in a manner sufficient to render the resulting part as structurally sound. As used herein, a part that is "structurally sound" is one that has mechanical properties that enable the part to withstand various operating stresses and strains incurred during use of the part.

Example(s) of the method disclosed herein may be used to form a part by bonding a metal (such as magnesium or magnesium alloys) to a substrate (such as aluminum, steel, titanium, etc.). The joint created between these materials is such that the part is considered to have the structural integrity necessary so that the part can be used in an automobile. In an example, the two materials may be joined together by improving the joint strength at an interface (i.e., its interfacial strength) between the metal and the substrate. This may be accomplished by altering the substrate surface in a manner suitable to promote a desired chemical reaction. More particularly, the joint strength may be improved by oxidizing the surface of the substrate, and forcing a chemical reaction between the metal and the oxidized surface to produce another oxide that enables the metal to chemically bond to the oxidized surface. In some instances, a physical bond may also form, such as a mechanical interlock created between the metal and the surface of the substrate.

One example of the method of bonding a metal to a substrate will be described in conjunction with FIGS. 1A-1F, 1F-A, 2A, and 2B. In this example, the part 10 (shown in FIG. 1F), which is formed by the method, includes an aluminum substrate and a magnesium metal bonded thereto. It is to be understood that the method may also or otherwise be used to form parts made from other combinations of materials. For instance, the part may be formed from substrate materials that may suitably be used for automotive applications (e.g., to make an automotive chassis component, an engine cradle, an instrument panel (IP) beam, an engine block, and/or the like). The substrate may, in some cases, be chosen from materials that are refractory enough so that the substrate material does not melt when exposed to the molten metal during over-casting, details of which will be provided below at least in conjunction with FIG. 1D. The substrate materials may be chosen from a metal. In one example, the metal may be chosen from aluminum, titanium, and alloys thereof which may form a porous oxide structure when anodized (described further below). In another example, the metal may be chosen from copper, nickel, and alloys thereof which may form a porous oxide structure when exposed to an oxidizing technique other than anodization (also described further below). It is to be understood that other materials may also be used as appropriate with respect to the method disclosed herein, some examples of which include cast iron, superalloys (e.g., those based on nickel, cobalt, or nickel-iron), steel (which is an alloy of iron, carbon, and possibly other components), brass (which is a copper alloy), and non-metals (e.g., high melting temperature polymers, such as those having a melting temperature of at least 350° C., glass, ceramics, and/or the like). The substrate material may otherwise be chosen from a material to make a part that is suitable for use in other applications, such as non-automotive applications including aircraft, tools, housing/building components (e.g., pipes), etc. In these applications, the substrate material may be chosen from any of the metals listed above, or may be chosen from another metal or non-metal (e.g., steel, cast iron, ceramics, high melting temperature polymers (such as, e.g., crystal polymers, polyimides, polyether imides, polysulfones, and/or other polymers having a melting temperature of at least 350° C.), etc.). The high melting temperature polymers may further include a protective layer and/or be cooled to prevent the polymer from melting and/or decomposing so that the combination of the polymer, protective layer, and the over-casting process does not significantly damage the substrate (i.e., the article formed by the substrate/over-cast metal system is still functional for its intended purpose).

If the substrate is chosen from a metal other than aluminum or another metal that forms a porous oxide structure when anodized, the substrate material may, in an example, be aluminized (i.e., the formation of an aluminum or aluminum-rich alloy layer on the surface of the substrate material) to be used in the method disclosed herein. For instance, steel may be aluminized via hot-dipping the steel in an aluminum-silicon melt, which forms an aluminum layer on the steel surface. This aluminum layer may later be anodized to form alumina, as described in detail below. It is believed that other materials, e.g., copper, may also be aluminized via hot-dipping or another suitable method such as, e.g., vapor deposition.

It is to be understood that an alumina surface may not be required to perform examples of the method disclosed herein. For instance, magnesium or another metal may be oxidized to form an oxide layer and, if desired, pores may be formed therein. Therefore, other systems may be used beyond over-casting magnesium onto aluminum or an aluminized surface. Other methods of forming a porous substrate surface (for those example methods disclosed herein where a porous surface is formed) are also contemplated herein, and are considered to be within the purview of the instant disclosure. One way of forming the oxide structure is to deposit the oxide onto the surface of the substrate. This may be accomplished, for example, by electroplating another oxidizable metal onto the substrate surface, and then oxidizing the other metal. Still other methods include chemical vapor deposition, physical vapor deposition, thermal spraying, and a dipping process. The dipping process may involve dipping the substrate 12 into a molten metal to create a thin metal layer on the surface S, and then oxidizing the metal. Examples of other methods of forming pores in the oxidized substrate surface include electroplating, electro-discharge, a process utilizing a laser, and/or shot blasting with or in an oxide environment. In one example, the pores may then be formed in the oxide (to form the oxide structure) via electro-discharge using a suitable electrode in an oxide environment. If, for example, electroplating is used as a way of creating a porous surface, the porosity of the surface may be controlled using a patterning and/or masking process (such as lithography), sputtering of non-conductive materials, etc.

In one example, the metal to be bonded to the substrate may be chosen from any metal in the periodic table of elements that has a melting point or temperature that is lower than, or near (e.g., within 1° C. of) the melting temperature of the substrate to which metal is bonded. It is to be understood that the over-cast metals discussed herein may be the pure metal or an alloy thereof. Further, the substrate should be refractory enough so that it does not melt too severely during casting. It has been found that selecting metals having a lower melting point than the substrate enables casting to be accomplished without melting the underlying substrate. For example, magnesium may be selected as a metal to be over-cast on any of the substrate materials listed above (e.g., aluminum, titanium, copper, alloys thereof, etc., except for, in some instances, magnesium), at least in part because the melting temperature of magnesium is about 639° C. and is lower than any of these substrate materials. Some examples of combinations of the metal and substrate that may be used to form an automotive part, for instance, include i) magnesium and aluminum, respectively, and ii) magnesium and steel, respectively. Other examples of metals that may be chosen include aluminum, copper, zinc, titanium, iron, and alloys thereof. If aluminum is selected as the metal, the aluminum may be bonded to substrate materials having a melting temperature that is lower than aluminum. For instance, aluminum (which has a melting temperature of about 660° C.) may be bonded to copper (which has a melting temperature of about 1083° C.), titanium (which has a melting temperature of about 1660° C.), or steel (e.g., stainless steel has a melting temperature of about 1510° C. and carbon steel has a melting temperature ranging from about 1425° C. to about 1540° C.). Further, if copper is chosen as the metal, then the copper may be bonded to steel at least in part because copper has a lower melting temperature than steel.

It is to be understood that, in some examples, the melting temperature of the over-casting metal does not have to be less than the substrate, at least in part because the substrate may include a protective layer, be subjected to cooling, and/or have a mass and conductivity that is sufficient to extract the heat of solidification before melting. For instance, aluminum (again, which has a melting temperature of about 660° C. may be over-cast on magnesium (which has a melting temperature of about 639° C.) if the over-casting is performed, e.g., in a die caster with a cooling mechanism to cool the magnesium.

As such, it is believed that the over-cast metal may otherwise be selected from a metal that has a higher melting temperature than the substrate. In this example, the substrate material may be cooled during the over-casting, and/or have a mass that is sufficient so that the molten over-cast metal solidifies before the metal deleteriously affects the structural integrity of the substrate, and/or have a protective layer thereon. In some instances, the heat transfer to the substrate may be low enough so that the temperature of the substrate does not reach its melting temperature, and thus will not melt (or melts slightly). In some instances, a coating (made from a material that has, e.g., a very high melting temperature (e.g., alumina)) may be established on the substrate that can reduce the heat transfer to the substrate. For example, alumina (which has a melting temperature of about 2072° C.) may be used as a suitable coating for the substrate. It is to be understood, however, that the coating material selected should also be durable and adherent so that the material can contribute to the structural integrity of the formed part. For instance, a material that may be deficient in durability and adhesion may be used as a coating so long as the material is combined with suitable additional components to increase its durability and adhesion.

Accordingly, in an example, when the metal is magnesium, the substrate may be chosen from aluminum, titanium, manganese, chromium, zinc, iron, copper, and alloys thereof.

While several examples have been given herein, it is to be understood that any combination of substrate and over-cast metal materials may be used so long as the casting procedure (e.g., casting temperatures, times, etc.) is such that over-casting may be accomplished without significantly damaging the substrate.

Additionally, there is a hierarchy of the over-cast metals, where a metal positioned at a higher position on the list can thermodynamically reduce the oxide of the metal positioned lower on the list. This list, which includes the highest metal position first and the lowest metal position last, includes: magnesium, lithium, aluminum, titanium, silicon, vanadium, manganese, chromium, sodium, zinc, potassium, phosphorus, tin, iron, nickel, cobalt, and copper. For example, aluminum may be over-cast on titanium oxide; but cannot be effectively over-cast on magnesium oxide (i.e., a desirable reaction between the materials will not occur).

It is to be understood that the silicon identified in the list above may, in some instances, be used in an alloy such as, e.g., an aluminum-silicon alloy having an aluminum and silicon eutectic structure. Oxidation of the aluminum-silicon alloy may create a structure including oxides of aluminum and oxides of silicon.

In the examples of the method described in detail below, the substrate material is specifically chosen from aluminum or aluminum alloys and the bonding metal is chosen from magnesium or magnesium alloys. For purposes of illustrating the example methods below, a part is formed including an aluminum substrate and magnesium bonded thereto.

The example of the method depicted in FIGS. 1A-1F generally involves selecting a substrate 12 (shown in FIG. 1A), and then oxidizing the surface S of the substrate 12 to form an oxide layer (identified by reference character 18 in FIG. 1B). After the surface S is oxidized, upon introducing an over-cast metal (identified by reference character M in FIG. 1D), a reaction occurs at an interface (e.g., $I_1$, $I_2$ shown in FIG. 1D) formed between an over-cast metal M and the metal oxide layer 18 formed on the substrate surface S. The foregoing reaction(s) forms another oxide, which is an intermediate product (shown, e.g., as layer 20 in FIGS. 1E and 1F) that enables the over-cast metal M to chemically bond with the oxide layer 18 (and the substrate 12) and form a metal layer 14 (shown in FIG. 1F). Further details of the formation of the other oxide 20 will be described below at least in conjunction with FIGS. 1E and 1F.

In an example, the oxide layer 18 is a porous oxide layer, and the layer 18 may be formed by growing the oxide layer 18 on the substrate surface S via an anodization process. Briefly, anodization is the oxidation of a portion of the aluminum substrate 12 to form the structure 18 made of aluminum oxide (i.e., alumina). Thus, a portion of the aluminum substrate 12 is consumed as the aluminum oxide structure 18 grows. Anodization may be accomplished, for instance, by employing the aluminum substrate 12 as the anode of an electrolytic cell, and placing the anode and a suitable cathode in an aqueous electrolyte. Some examples of the electrolyte include sulfuric acid ($H_2SO_4$), phosphoric acid ($H_2PO_4$), oxalic acid ($C_2H_2O_4$), and chromic acid ($H_2CrO_4$). These electrolytes desirably form porous alumina; i.e., an alumina structure 18 including the nano-pores 16 formed therein. Further, any suitable cathode may be used, examples of which may include aluminum or lead. A suitable voltage and current (e.g., a DC current or, in some cases, a DC component and an AC component) is applied to the electrolytic cell for an amount of time to anodize a selected portion of the aluminum substrate 12 to grow the structure 18. In an example, about 0.1 μm to about 50 μm of the aluminum substrate is anodized depending, at least in part, on the desired thickness of the porous oxide layer to be formed. For instance, it is believed that, for anodizing using a sulfuric acid electrolyte, every 3 μm of the oxide layer that is formed consumes about 2 μm of the underlying substrate. It is further believed that the foregoing ratio may change based, at least in part, on the porosity of the anodized layer and the mass balance of the metal oxide layer and the underlying substrate.

In an example, anodization may occur at a voltage ranging from about 1 V to about 120 V, and the voltage may be adjusted as desired throughout the anodization process as the oxide layer (or structure 18) grows thicker.

It is to be understood that other parameters may be adjusted, in addition to the voltage, to control the thickness of the oxide layer 18. For instance, the thickness of the oxide layer 18 depends, at least in part, on the current density multiplied by the anodization time. Typically, a particular voltage is applied in order to achieve the current density required to grow the oxide layer 18 to a desired thickness. Furthermore, the electrolyte used, as well as the temperature may also affect the properties of the oxide layer 18, and the ability to grow and form the oxide layer 18 to a desired thickness. For instance, the thickness of the oxide layer 18 may depend on the conductivity of the electrolyte, which in turn depends on the type, concentration, and the temperature of the electrolyte. Further, the oxide layer 18 is electrically insulating, and thus at a constant voltage, the current density will decrease as the layer grows. In some cases, the decrease in current density may limit the maximum growth of the oxide layer 18, and thus the voltage cannot always be continuously increased to increase the thickness of the layer 18. However, in some instances, it may be desirable to increase the voltage throughout the process. In one example, the voltage applied may start at about 25 V to 30 V, and then the voltage may ramp up to a higher voltage as the oxide layer 18 grows.

Additionally, the size of the nano-pores 16 may be controlled at least by adjusting the voltage, but the adjustment to the voltage may change depending on the material(s) used (e.g., the substrate material). In one example, nano-pores 16 have an effective diameter D (see FIG. 1F) of about 1.29 nm per 1 V of voltage applied, and the spacing between adjacent pores 16 is about 2.5 nm per 1V of voltage applied. The pore 16 size and spacing will be described in further detail below.

It is believed that the growth of the structure 18 (i.e., the porous aluminum oxide layer) depends, at least in part, on current density, the chemistry of the electrolytic bath (i.e., the electrolyte), the temperature at which anodization occurs, the amount of anodization time, and/or the voltage applied. In some cases, certain properties of the structure 18 may also be controlled by incorporating AC current in place of or superimposed onto the DC current. Furthermore, anodization may be accomplished at a temperature ranging from about −5° C. to about 70° C. (or in another example, from about −5° C. to about 10° C.), and the process may take place for a few minutes up to a few hours depending, at least in part, on a desired thickness of the structure 18 to be grown. In one example, the thickness of the oxide layer or structure 18 grown ranges from about 2 μm to about 250 μm. In another example, the thickness of the oxide layer or structure 18 grown ranges from about 40 μm to about 80 μm.

The porous oxide structure 18 formed via the anodization process described above may include many nano-pores 16 defined therein, and a barrier layer 19 of alumina defining the bottom of each pore 16. The barrier layer 19 is a thin, dense layer (i.e., with little porosity, if at all), and may constitute about 0.1% to about 2% of the entire thickness of the oxide structure 18 formed.

As used herein, the term "nano-pore" refers to a pore having an effective diameter (knowing that each pore may not have a perfectly circular cross section) falling within the nanometer range (e.g., from 1 nm to 1000 nm); and the pore may extend at least partially through the oxide structure 18. In some cases, the oxide structure 18 may be etched to remove portions thereof at the bottom of the nano-pores 16 (including the barrier layer 19), thereby exposing the underlying aluminum substrate 12. Each nano-pore 16 has a substantially cylindrical shape that extends throughout the length of the pore (as schematically shown, for example, in FIG. 2A). It is to be understood that the size of the nano-pores 16 depends, at least in part, on the anodization parameters as described above. Further, it is assumed that the effective diameter of each pore 16 is about the same, and that the effective diameter is also substantially the same throughout the length of the pore 16. It is to be understood, however, that each nano-pore 16 may not necessarily have a diameter that is consistent throughout its length; e.g., one or more pores 16 may have a diameter that is smaller at the top of the pore 16 (e.g., the end of the pore opposed to the substrate surface S) and bigger at the bottom of the pore 16 (e.g., the end of the pore adjacent to the substrate surface S). In another example, the nano-pores 16 may have a bulb-like shape, where the effective diameter near the mid-point of the length of the pore 16 is larger than at both ends of the pore 16. The nano-pores 16 may otherwise have another configuration not specifically mentioned here.

In an example, the effective diameter D of each nano-pore 16 (shown in FIG. 1F-A) ranges from about 15 nm to about 160 nm. In another example, the effective diameter D of each nano-pore 16 ranges from about 25 nm to about 75 nm. In still another example, the effective diameter D ranges from about 50 nm to about 150 nm. It is to be understood, however, that the desired effective diameter D (or size) of the nano-pores 16 may depend, at least in part, on the fluidity, viscosity, and wettability of the molten metal M, at least in part because the molten metal M will be penetrating the nano-pore 16. Further, the size of the nano-pores 16 may also depend on whether or not the substrate surface S is wetting to the metal M (which will be described in further detail below). Generally, in instances where the surface S is wetting to the metal M, the desired size of the nano-pores 16 may be smaller than when the surface S is non-wetting to the metal M.

Further, the diameter of the nano-pores 16 may vary through the height of the oxide structure 18 (e.g., where the nano-pores 16 have segments with different diameters). This may be accomplished by growing the oxide layer 18 at a first voltage, where the pore 16 size attempts to reach a steady state. Then, during the process, a transition zone is created by changing the voltage so that the pores 16 attempt to reach another steady state. More specifically, the steady state diameters of the nano-pore 16 depend, at least in part, on the voltage. For instance, a first voltage may be used to grow the nano-pores 16 initially until a first steady state diameter is reached, and then a second voltage may be used for further growth of the nano-pores 16 until a second steady state diameter is reached. The transition zone of the first and second diameters of the nano-pores 16 occurs between the first and second voltages.

Across a substrate surface S, areas with and without nano-pores 16 may be formed. This may be accomplished using a mask. The mask prohibits pore formation and thus the masked areas include no nano-pores. These masked areas of the substrate surface S may be larger in scale (e.g., micrometers or even millimeters) than the size of the individual nano-pores 16 grown in the unmasked areas. Depending upon the mask used, this method can create discontinuous areas (i.e., nano-islands, discussed further hereinbelow) that contain nano-pores 16 or a continuous nano-pore-containing layer that has multiple holes (i.e., areas without nano-pores 16) formed therein. It is also contemplated herein to form nano-pores 16 across the substrate surface S having different dimensions. This may be accomplished, for example, by masking a first area of the surface S, and allowing the nano-pores 16 to grow in the unmasked area while applying a suitable voltage for growth. Thereafter, the area of the substrate surface S including nano-pores 16 grown therein may be masked to preserve the dimensions of those nano-pores 16. The previously masked area of the surface S is now unmasked. A different voltage may be applied to the newly unmasked area to grown nano-pores of another desired size.

The nano-pores 16 may be, for example, uniformly situated in the oxide structure 18, where the pores 16 are aligned. This is shown in FIG. 2A. In other words, the nano-pores 16 grow normal to the surface during the anodization process described above. It is to be understood that the nano-pores 16 may show some randomness, at least in terms of the their respective positions in the oxide layer 18, and thus the configuration of the nano-pores 16 shown in FIG. 2A is not considered to be the typical case. It is further to be understood that certain positioning techniques may be applied in order to control the positioning of the nano-pores 16 in order to achieve a more uniform configuration, such as the one shown in FIG. 2A. The number of nano-pores 16 formed depends, at least in part, on the size (e.g., effective diameter) of each individual pore 16 and the surface area of the substrate surface S that is anodized. As one example, with a 40 V of applied voltage, the number of nano-pores 16 formed ranges from about $1\times10^9$ to about $1\times10^{10}$ per $cm^2$ of substrate surface. In one example, the part 10 may have a surface area of about 200 $cm^2$, and thus the number of pores 16 is about $2\times10^{11}$. Further, if each pore 16 is defined inside a cell (such as the cell C shown in FIG. 2B), the size of each cell may range from about 100 nm to about 300 nm. In an example, the spacing d (shown in FIG. 1F-A) between adjacent pores 16 formed in the structure 18 ranges from about 100 nm to about 300 nm. In another example, the spacing between adjacent pores 16 ranges from about 180 nm to about 220 nm. In still another example, the spacing between adjacent pores 16 is about 200 nm.

In some cases, it may be desirable to select certain portion (s) of the aluminum substrate 12 to which the magnesium will be bonded, or to select where (on the aluminum substrate 12) to form the nano-pores 16. In these cases, the unselected portions of the substrate surface S are not anodized. This may be accomplished, for instance, by patterning the aluminum substrate 12 prior to growing the oxide structure 18 from it. Patterning may be accomplished via any suitable technique, and is used to perform localized anodization of the aluminum substrate 12. For instance, any standard photolithography method may be utilized, one example of which includes depositing a hard mask material on the aluminum, and then using a photoresist to pattern the mask material to allow localized exposure of the aluminum. In an example, the mask is patterned to expose portion(s) of the aluminum to the electrolyte from which the oxide structure 18 may be selectively grown. The areas that remain exposed once the mask and photoresist are in position may then be subject to local anodization, and the aluminum exposed via the patterned mask is locally anodized, for example, by employing the exposed or patterned aluminum layer as the anode of the electrolytic cell described above.

It is believed that patterning may also be used to alter a stress pattern at certain, perhaps critical, areas of the interface formed between the metal M and the substrate 12. These critical areas may be, for example, those areas that tend to be exposed to higher loads during use (such as, e.g., those surfaces exposed to wear or rolling contact). For instance, a strong bond may be formed at areas on the substrate surface S where there is a high density of nano-pores 16 that the metal M can interact with during over-casting. Patterning (using a mask as described above) may be used, for instance, to reduce the number of pores 16 at certain areas on the substrate surface S. This may be useful, for example, when it is desirable to transfer stress from the substrate 12 to the over-cast metal M, or visa versa.

It is to be understood that the radius between certain section sizes may also be considered to be areas with increased stress. For these areas, patterning in combination with multiple anodization treatments using different voltages or times may create surfaces with different porous structures. For instance, a surface may be anodized a first time, and then a portion of the surface is masked. A second anodization treatment may then be applied to the unmasked portion of the surface using a different voltage than was used during the first anodization treatment. After the second anodization is complete, the area of the surface that was unmasked includes nano-pores 16 that vary in diameter along their respective lengths. The nano-pores 16 formed during the first anodization process in the masked area remain unchanged as a result of the second anodization process. As such, the nano-pores 16 in the masked area may include substantially uniform nano-pores that are shorter or longer in length (depending, at least in part, on how the anodization voltage or time was changed during the second anodization treatment) than the nano-pores 16 formed in the non-masked area of the surface.

As briefly mentioned above, patterning may be used to create areas between clusters of nano-pores 16, where each cluster may be referred to as a nano-island. These nano-islands may be useful in instances where the molten metal M cannot sufficiently penetrate the nano-pores 16 (i.e., when no nano-islands are present) which may be due, at least in part, to surface tension. It is believed that the presence of the nano-islands surrounded by denuded areas (i.e., areas without any nano-pores) increases the surface area of the substrate surface S that the molten metal M may suitably penetrate during over-casting. In an example, the porous nano-islands are formed by masking portions of the substrate surface S. The unmasked areas will undergo growth and nano-pore formation, and thus will become the nano-islands. The unmasked portions are anodized to form nano-pores 16 and nano-islands. It is to be understood that the term "nano" when used in conjunction with the porous nano-island refers to the size (i.e., effective diameter) of the individual nano-pores 16 formed in the nano-island. Although it is possible that the surface area of the nano-island may fall within the micrometer range (1 $\mu m^2$ to 1000 $\mu m^2$), the surface area of the nano-island may be as large as desired.

Also as briefly mentioned above, a continuous nano-porous layer may be formed that includes non-porous depressions/holes. This may be formed by masking the designated portions of the substrate surface S that will form the depressions, and exposing the unmasked portions of the surface S to anodization. The areas surrounding the depressions contain nano-pores 16, while the depressions do not contain nano-pores 16. The size of the depressions may also be in the nanometer scale, but may also be as large as desired. Further, the depressions may take any shape or form, such as circles, squares, straight lines, squiggly lines, a flower shape, etc. It is also believed that the presence of the depressions also increases the surface area of the substrate surface S that the metal M may penetrate during over-casting.

Other methods of forming a porous substrate surface are also contemplated here, and are considered to be within the purview of the instant disclosure. One way of forming the oxide structure 18 is to deposit the oxide onto the surface of the substrate 12. This may be accomplished, for example, by electroplating another oxidizable metal onto the substrate surface 12, and then oxidizing the other metal. Still other methods include chemical vapor deposition, physical vapor deposition, thermal spraying, and a dipping process. The dipping process may involve dipping the substrate 12 into a molten metal to create a thin metal layer on the surface S, and then oxidizing the metal.

Examples of other methods of forming pores in the oxidized substrate surface include electroplating, electro-discharge, a process utilizing a laser, and/or shot blasting with or in an oxide environment. In one example, the pores 16 may then be formed in the oxide (to form the oxide structure 18) via electro-discharge using a suitable electrode in an oxide environment. If, for example, electroplating is used as a way of creating a porous surface, the porosity of the surface may be controlled using a patterning and/or masking process (such as lithography), sputtering of non-conductive materials, etc.

It is to be understood that, in some cases, an oxide layer may naturally form on the substrate surface S (e.g., $Cr_2O_3$ may naturally form on the surface of stainless steel, $Fe_2O_3$ may naturally form on the surface of regular steel, alumina may naturally form on the surface of aluminum, etc.). However, the naturally occurring oxides may, in some instances, not be strong enough to ultimately form a chemical bond with an over-cast metal M. It is to be understood that the natural formation of the oxide layer 18 from the substrate 12 may be aided by a chemical environment without the use of electricity (e.g., iron oxide may grow faster in the presence of salt water when placed in an oxidizing environment at a high temperature) in order to form a strong oxide structure 18 upon which the metal M may be bonded.

It is believed that the presence of the nano-pores 16 in the oxide structure 18 enable the molten metal M to not only react with the oxide of the structure 18, but also provides an avenue for the molten metal M to reach and react with the underlying substrate 12 (e.g., when the barrier layer 19 is removed via etching). In this configuration, it is possible to create two separate chemical bonds: one with the metal oxide of the structure 18 and the other with the metal of the substrate 12.

It is further believed that the presence of the nano-pores 16 increases the surface area of the metal oxide structure 18 for reaction with the over-cast metal M, and thus more oxide is available to the over-cast metal M to create a stronger chemical bond. Additionally, the nano-pores 16 may facilitate some mechanical bonding between the oxide structure 18 and the metal M when solidified. Details of the mechanical bonding mechanism may be found in U.S. Provisional Application Ser. No. 61/488,958 filed May 23, 2011.

Once the aluminum oxide structure 18 has been formed, the example of the method shown in FIGS. 1A through 1F further includes providing oxygen ions from a source of oxygen (e.g., oxygen gas, material containing oxygen, atmospheric oxygen, etc.) to the system, where the oxygen is consumed during the reaction between the oxide layer 18 and the metal M to form the other oxide. In instances where the metal M contacts the underlying substrate 12, a reaction between the metal M and the substrate 12 may also occur. In an example, the source of oxygen is a material that is introduced into the nano-pores 16, as shown in FIG. 1C. The introduction of the material into the nano-pores 16 may be accomplished via a deposition process, such as chemical vapor deposition (CVD) or electrochemical deposition.

Another way of introducing the material includes utilizing a sol-gel application process (i.e., a wet-chemical technique where a solution (i.e., a sol) gradually forms a gel-like network that contains both a liquid and a solid phase). The sol-gel may be applied to the nano-pores 16 via several ways, such as by painting, dipping, spraying, electrophoresis, or the like. When applied, the sol-gel wicks into the nano-pores 16, and thereafter converts into an oxide. The conversion of the sol-gel into an oxide may be accomplished by exposing the sol-gel to a moist environment to hydrolyze the sol-gel. The oxidized sol-gel may be exposed to heat to dry the oxide, as well as to decompose any hydroxides present and to remove any absorbed water. Yet another way of introducing the material into the nano-pores 16 includes immersing the substrate 12 (which includes the oxide layer 18) in a bath containing the oxygen-containing material.

The material used as the source of oxygen may be chosen from any reducible oxide that is on the thermodynamic list identified above, and the selected reducible oxide is one that has a smaller negative free energy of formation than that of the oxide of the over-cast metal M. In instances where the over-cast metal M is magnesium, then some examples of reducible oxides that may be used for the oxygen-containing material include $Mn_3O_4$, $Mn_2O_3$, MnO, $Na_2O$, $SiO_2$, $SnO_2$, CdO, ZnO, $Al_2O_3$, FeO, $Fe_2O_3$, $Fe_3O_4$, $Cr_2O_3$, and $TiO_2$.

Once the oxygen-containing material (represented as $O_2$ in FIG. 1C) has been introduced into and over the nano-pores 16, the magnesium metal M is bonded to the substrate 12. This may be accomplished, for example, by placing the substrate 12 including the structure 18 grown thereon in a casting die or mold (not shown in the figures), and then over-casting the magnesium metal M onto the substrate surface S, as shown in FIG. 1D. Over-casting generally involves introducing (via, e.g., pouring) the metal M (e.g., magnesium), in a molten state, over the aluminum substrate 12. For instance, solid magnesium is melted into the molten state by heating the magnesium above its melting temperature. Then, a casting tool 22 (such as a ceramic or metallic crucible or ladle, as shown in FIG. 1D) is utilized to pour the molten magnesium metal M over the aluminum 12 inside the casting die or mold. In some cases, the molten metal M may be introduced by placing the substrate 12 in a cavity (e.g., a mold) and then injecting the metal M into the cavity. In yet another example, a counter-gravity, low pressure die casting process may be used where the mold is above a bath of the molten metal M, and the metal M is introduced into the mold via a mechanical pump or by using a gas pressure on the bath to force the metal M up to the mold. The molten magnesium M flows over the oxide structure 18, and the over-casting process is considered to be complete, for instance, when the layer 14 (shown in FIG. 1F) having a desired thickness is formed over the structure 18 and is solidified.

It is believed that the magnesium metal M, which is over-cast while in a molten state, penetrates and/or reacts with the nano-pores 16 formed in the oxide structure 18. In some instances, the magnesium metal M flows through the nano-pores 16, and may also contact the underlying substrate 12. The magnesium metal M contacts the underlying substrate 12 in instances where the alumina layer 18 and barrier layer 19 are etched to expose the underlying substrate 12. It is to be understood, however, that a strong bond may form without the metal M flowing all of the way through the pores 16 so long as the magnesium metal M suitably bonds to the alumina 18.

When the metal M is over-cast onto the structure 18, in this example, the molten magnesium metal M reacts with the metal oxide of the structure 18 in the presence of the oxygen to form another, new oxide layer 20 (shown in FIG. 1E). It is believed that this other oxide layer 20 chemically bonds to the initial oxide layer 18, where the initial oxide layer 18 chemically bonds to the underlying substrate 12. In one example, the oxygen is extracted from the oxygen-containing material introduced onto the surface S and/or into the nano-pores 16, and is utilized in the reaction at the interfaces between the metal M and the oxide layer 18 (e.g., an interface $I_1$ at an exposed, top surface of the oxide layer 18 and interface $I_2$ at the surface of the oxide layer 18 defining each of the nano-pores 16, as shown in FIG. 1D) to form the other oxide 20, shown in FIG. 1E. It is to be understood that a portion of the oxide layer 18 (e.g., the top of the oxide layer 18, as well as the oxide defining each of the nano-pores 16) is consumed during the chemical reaction to form the other oxide 20. An example of a reaction that may take place at the interfaces $I_1$, $I_2$ between the magnesium metal M and the alumina layer 18 is shown by equation (1) below:

$$Mg+Al_2O_3+\tfrac{1}{2}O_2 \rightarrow MgAl_2O_4 \qquad \text{(Eqn. 1)}$$

In a more specific example of the example described immediately above, $SnO_2$ (if used as the source of oxygen) may be introduced into the nano-pores 16, and then the molten magnesium metal M may be poured (i.e., over-cast) onto the oxide layer 18 including the nano-pores 16 having the $SnO_2$ disposed therein. The magnesium metal M flows into and fills the nano-pores 16, and reacts with the oxide layer 18 in the presence of oxygen ions extracted from the $SnO_2$. The metal portion of the $SnO_2$, after the oxygen ions have been extracted therefrom, may then go into solution with the molten metal M and either i) become soluble in, or ii) form an intermetallic precipitate in the subsequently solidified, over-cast magnesium metal M. In the first instance, the Sn component of the oxide will go into solution with the magnesium metal during over-casting and become dispersed as soluble atoms in its solidified crystal structure. In the latter instance, the Sn component of the oxide will go into solution with the magnesium metal during over-casting and produce a Sn-containing intermetallic precipitate in the solidified metal. It is believed that the presence of the Sn-containing precipitate does not affect the final structural integrity of the formed part 10 shown in FIG. 1F. The reaction for this example (i.e., creation of the Sn-containing precipitate) is shown by equation (2) below:

$$2Mg+2Al_2O_3+SnO_2 \rightarrow 2MgAl_2O_4+Sn \qquad \text{(Eqn. 2)}$$

In the example provided immediately above, the other oxide 20 that is formed (i.e., $MgAl_2O_4$) is a spinel. A spinel is a crystalline material where the oxide anions are arranged in a cubic, close-packed lattice and the cations (i.e., Mg and Al) occupy some or all of the octahedral and tetrahedral sties in the lattice. It is believed that the formation of the spinel (shown as a layer 20 formed on the oxide layer 18 and inside the nano-pores 16 in FIGS. 1E and 1F) creates a strong chemical bond between the magnesium M and the aluminum oxide layer 18. It is further believed that this chemical bond advantageously improves the interfacial strength of the part 10 (shown in FIG. 1F) formed by the method.

It is to be understood that the over-casting process is typically completed relatively quickly (e.g., within a few milliseconds for a thin-wall casting die). In these instances, the over-casting may be completed before the other oxide- (or spinel-) forming reaction has a chance to complete as well. It may, in some cases, be desirable to apply additional heat to further the oxide- (or spinel-) forming reaction to drive the reaction to completion after the over-casting process is finished. Heating may be accomplished, e.g., by placing the part in an oven, furnace, or the like, or heating may be accomplished via other known heating practices.

Figure 1F:
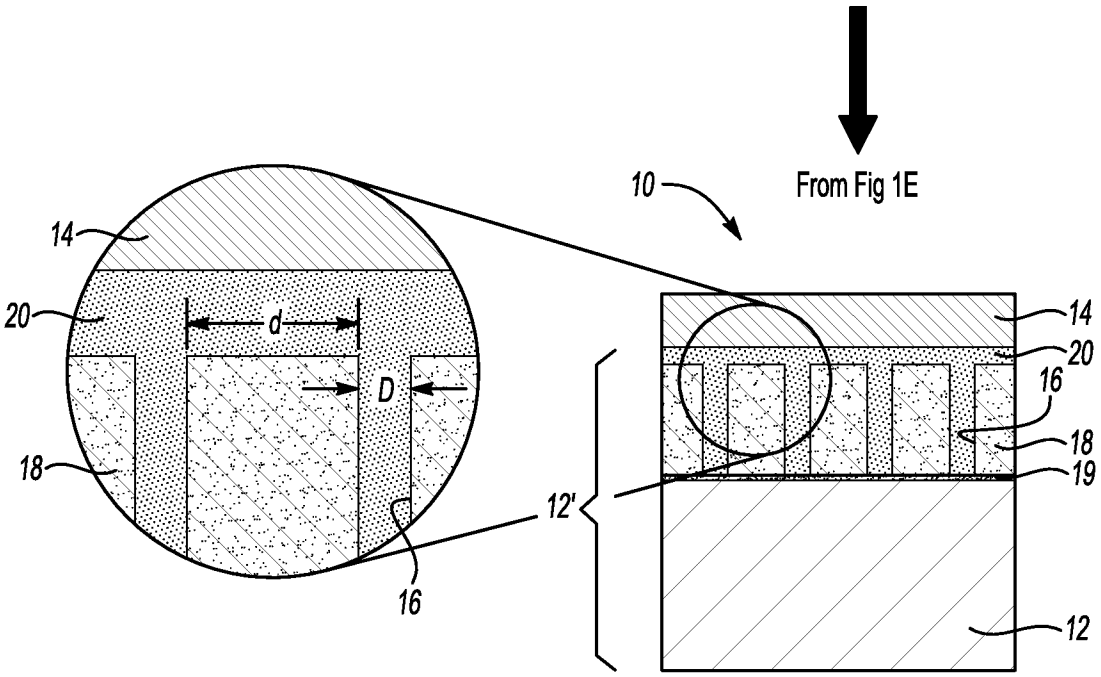
Figure 2A:
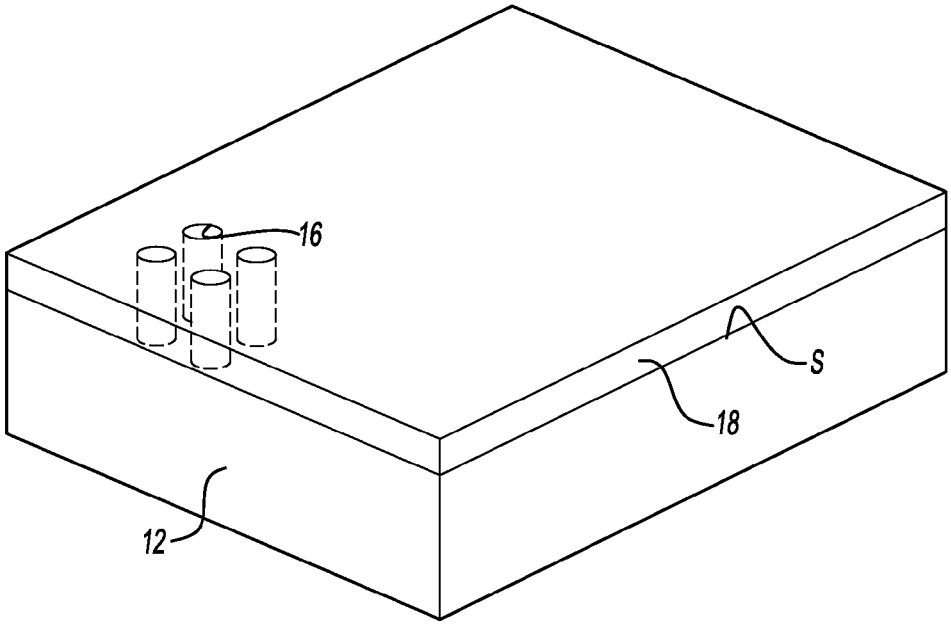
FIG. 2A is a perspective view schematically depicting an example of a substrate including a plurality of nano-pores formed in a surface thereof.
Figure 2B:
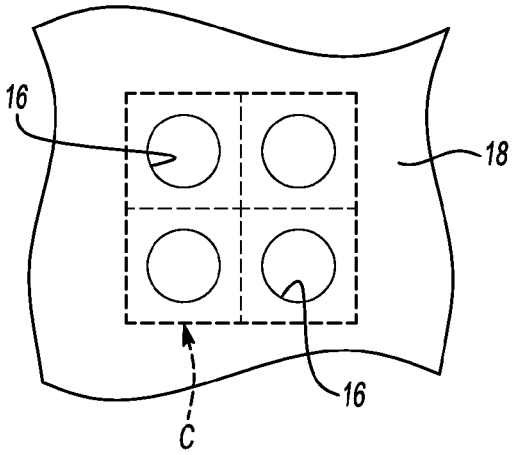
FIG. 2B is a plan view of the plurality of nano-pores shown in FIG. 2A.

As also shown in FIG. 1F, the part 10 is formed upon solidifying the molten metal M so that the solidified metal forms a layer 14 of magnesium (or other metal M) bonded to the substrate 12' (which now includes the substrate metal 12, the oxide structure 18, and the spinel 20). It is to be understood that the formation of the oxide structure 18 and the spinel 20 is accomplished during a single application of the magnesium metal M. Further, a portion of the magnesium metal Mapplied forms the spinel 20, at least in part because the amount of metal Mapplied is significantly greater than the amount needed to form the spinel 20 (which depends on the amount (or thickness) of the oxide structure 18 previously formed on the substrate 12). In an example, the spinel 20 layer has a thickness ranging from about 10 nm to about 10 μm, compared to the thickness of the metal layer 14 which may be at least 1 mm thick. In another example, the other oxide 20 (e.g., the spinel) forms as a layer having a thickness ranging from about 0.1 μm to about 500 μm. In an example, the amount of metal M consumed to form the spinel 20 may be determined from the reaction, such as the reaction shown in Equation 1 above. In this example, if the alumina ($Al_2O_3$) has a surface area of 1 $cm^2$ and a thickness of 100 um, and the surface is about 25% porous, about 30 mg of $Al_2O_3$ reacts with about 7 mg of magnesium M to form the spinel 20. Any additional magnesium M becomes the layer 14.

In some cases, the layer 14 of magnesium metal may be formed on the substrate 12' according to the shape of the casting die or mold. In an example, solidification of the metal M to form the layer 14 includes passively cooling the metal M, which enables the molten metal M that flowed over the oxide structure 18 to produce the spinel layer 20 and the metal layer 14 to cool. Passive cooling of the metal may be accomplished, e.g., via heat loss by natural radiation, convection, and/or conduction. In one example, these methods of heat loss may be accomplished by placing the part 10 at room temperature (e.g., at a temperature ranging from about 20° C. to about 30° C.). It is also contemplated that solidification may also be accomplished by placing the part 10 in a cooler or other device to expose the part 10 to colder temperatures that may, in some instances, lessen the amount of time needed to fully solidify the metal. In yet another example, the part 10 may be cooled inside the casting die or mold by reducing the temperature of the die or mold. In still another example, the part 10 may be heated to at least 100° C. (or even up to about 300° C.). In this example, the temperature at which the part 10 is heated is still lower than the solidification temperature of the metal, and thus the metal cools as heat is conducted into the substrate 12 and into the die/mold. The die/mold may be cooled using oil or water that passes through the die. In some cases, the molten metal M may solidify to form a flat layer 14 (as shown in FIG. 1F, for example), or may take the form of a predefined shape of the casting die or mold used for the over-casting.

Another example of the method will now be described in reference to FIGS. 1A through 1D and 1J. It is to be understood that this example of the method may also be performed without the step shown at FIG. 1C. The steps of the instant example of the method in conjunction with FIGS. 1A through 1C are the same as described in the example above. Referring back to FIG. 1D, in this example of the method, when the molten magnesium metal M is over-cast onto the structure 18, the metal M reacts with the metal oxide of the structure 18 and converts essentially the entire oxide structure 18 into a spinel 20'. The amount of the spinel 20' formed may be controlled by a combination of the starting oxide (i.e., the oxide structure 18) thickness, the amount of time that the molten metal M reacts with the starting oxide material 18, and any subsequent heat treatment applied to the formed part 10' to impart the desired properties to the part 10'. In an example, the entire structure 18 is essentially converted when the spinel 20' forms to a thickness that is greater than about 2 μm. The initial oxide layer 18 is converted into a new oxide which, in this case, is the spinel 20'. The part 10' formed by this method is schematically shown in FIG. 1J. It is believed that the part 10' formed includes a strong chemical bond formed directly between the substrate 12 and the spinel 20', and between the spinel 20' and the layer 14 of magnesium metal. Further, the metal M, while in the molten state, may flow into the nano-pores 16 of the spinel 20' and chemically bond to the spinel 20' at an exposed, top surface thereof, as well as at the surfaces defining the individual nano-pores 16.

In yet another example, the magnesium metal M may partially react with the initial oxide (i.e., the layer 18) and convert the partially reacted portion of the initial oxide 18 into a first spinel layer, and further react to create a new oxide (i.e., a second spinel layer) on the first spinel layer. This creates an overall graded spinel.

Another example of the method will be disclosed hereinbelow in conjunction with FIGS. 1A, 1B, and 1D through 1F. This example is essentially the same as the example described above in conjunction with FIGS. 1A through 1F; however the method does not include the step of providing oxygen ions from another source of oxygen for the reaction. Rather, in this example, upon forming the oxide structure 18 (as shown in FIG. 1B), the molten metal M is over-cast onto the oxide structure 18 and reacts with oxygen ions, e.g., that are extracted directly from the oxide structure 18. For instance, the substrate 12 may include elements that are useful for promoting the oxide reaction. In an example, the 300 series of aluminum casting alloys contain silicon in its eutectic structure, and the anodization (or other oxide-forming process) described above may be used to oxidize the silicon to form a silica ($SiO_2$) structure 18. In some cases, it may be desirable to etch or otherwise remove a portion of the surface of the substrate 12 material to expose the silicon prior to anodization. The metal M may react with the oxygen of the silica to drive the oxide-forming reaction. Since the magnesium metal tends to react with and reduce the oxide of the structure 18 directly, it is believed that a strong chemical bond may be formed (via, e.g., forming a spinel) between the magnesium metal and the oxide.

In another example, the molten magnesium metal M reacts with oxygen obtained from a gas present in the environment within which the bonding is taking place. The gas may include air from the surrounding environment, or the reaction may take place in an oxygen-enriched environment. It is believed that for this example (as well as the example described above where the source of oxygen is introduced directly into the nano-pores 16), an interfacial oxide will form at the interfaces $I_1$ and $I_2$, and then the magnesium metal M further reacts with the oxide of the structure 18 to form the spinel. The reaction for this example (i.e., reacting in an oxygen-enriched environment) is essentially the same as the reaction shown in Equation 1.

Figures 1G, 1H, 1I:
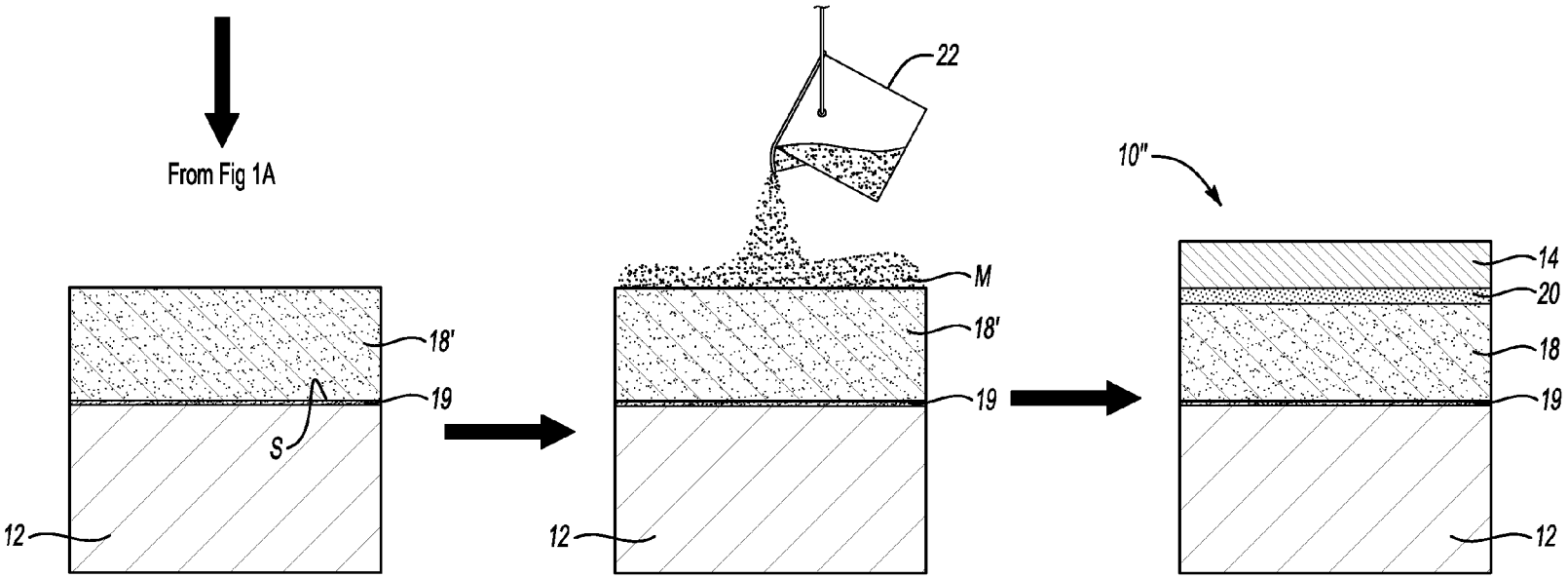

Yet another example of the method will be described below in conjunction with FIG. 1A and FIGS. 1G through 1I. In this example, the oxide layer 18' formed on the substrate surface S is a non-porous layer, as shown in FIG. 1G. In this example, the substrate 12 is selected from a material that does not form pores when oxidized. One example of this material is chromium plated on steel, where the chromium naturally forms an oxide on the surface of the steel. The molten metal M is over-cast onto the non-porous layer 18' (as shown in FIG. 1H) as previously described in conjunction with FIG. 1D, and the metal M reacts with the non-porous oxide layer 18' to form another oxide 20 (e.g., a spinel) (as shown in FIG. 1I). A layer 14 of the magnesium metal M then forms on the other oxide 20 to form the part 10" (as also shown in FIG. 1I). It is also contemplated herein to convert essentially the entire oxide structure 18' into the other oxide 20 during over-casting, similar to the example described in conjunction with FIG. 1J above. In other words, the anodized substrate surface S may be completely converted regardless of its porosity. In this example, the layer 14 of the magnesium metal forms directly on the converted oxide structure.

It is to be understood that any of the example methods described above may be used to form another oxide (e.g., oxide layer 20.20') as an intermediate layer between the metal and the substrate (e.g., when the substrate includes the oxide structure formed thereon), or as part of the substrate (e.g., when the oxide structure is entirely converted into the other oxide). Generally, the combination of materials used to form the part 10, 10', 10" needs a favorable free energy to react with the oxide formed on the substrate. Further, the structure of the other oxide that forms by the reaction between the over-cast metal and the substrate (or the oxide formed on the substrate) depends, at least in part, on the combination of metals used to form the part 10, 10', 10". For instance, when the part 10, 10', 10" is formed by bonding magnesium to aluminum, the other oxide that forms is a spinel. In instances where $MgAl_2O_4$ is formed, the spinel is a prototypical spinel having two different cations; $Mg^{+2}$ and $Al^{+3}$. Depending, at least in part, on the size and the electrical properties of the cations, a number of binary spinels may form (e.g., normal 2-3, normal 2-4, inverse 2-3, and inverse 2-4). It may also be possible to create defect spinels such as gamma $Al_2O_3$, which has a single cation and the cation is distributed on both the tetrahedral and octahedral sites of the spinel structure.

Other combinations of metals may form ternary or other higher ordered spinels (e.g., a quaternary spinel), for example, where two binary spinels or a binary spinel and a defect spinel are mixed together. For instance, the binary spinels $ZnAl_2O_4$ and $MgAl_2O_4$ may combine to form a ternary spinel. This may occur, for instance, when one spinel composition forms at an interface inside the nano-pores 16, and another spinel composition forms on the surface of the oxide layer 18. These spinels may react with each other to form yet another spinel during over-casting or during a subsequent heat treatment process.

Yet other combinations of metals may form an oxide that is not a spinel, and this oxide may take the form of a binary oxide, a ternary oxide, or an oxide having an order higher than ternary.

The examples of the method have been described above for forming an automotive part. As previously mentioned, the examples of the method may also be used to form non-automotive parts, such as for aircraft, tools, house components (e.g., pipes), and/or the like.

Additionally, the examples of the method have been described above as including forming another oxide as a reaction product from the reaction of the over-cast metal M and the oxide layer 18, 18'. It is to be understood that the examples of the method may also be used for forming other reaction products, such as a nitride, a carbide, a ceramic, or the like. These other products may be formed by the reaction between the over-cast metal M and an appropriate selected material for the layer 18, 18'.

It is to be understood that the ranges provided herein include the stated range and any value or sub-range within the stated range. For example, a thickness ranging from about 0.1 μm to about 500 μm should be interpreted to include not only the explicitly recited amount limits of about 0.1 μm to about 500 μm, but also to include individual amounts, such as 10 μm, 50 μm, 220 μm, etc., and subranges, such as 50 μm to 300 μm, etc. Furthermore, when "about" is utilized to describe a value, this is meant to encompass minor variations (up to +/−5%) from the stated value.

It is further to be understood that, as used herein, the singular forms of the articles "a," "an," and "the" include plural references unless the content clearly indicates otherwise.

While several examples have been described in detail, it will be apparent to those skilled in the art that the disclosed examples may be modified. Therefore, the foregoing description is to be considered non-limiting.

The invention claimed is:

1. A method of bonding a metal to a substrate, comprising:
forming an oxide layer on a surface of the substrate; and
in a molten state, over-casting the metal onto the substrate surface, the over-casting driving a reaction at an interface between the over-cast metal and the oxide layer to form an other oxide, wherein the other oxide binds the metal to the substrate surface upon solidification of the over-cast metal;
wherein the oxide layer includes a plurality of nano-pores defined therein.

2. The method as defined in claim 1 wherein after forming the oxide layer, the method further comprises providing a source of oxygen for the reaction at the interface by introducing a material into the plurality of nanopores, the material being the source of oxygen.

3. The method as defined in claim 2 wherein the material is introduced into the plurality of nanopores via any of chemical vapor deposition, electrochemical deposition, a sol-gel process, or immersion.

4. The method as defined in claim 2 wherein the material is chosen from a reducible metal oxide.

5. The method as defined in claim 1 wherein the metal is chosen from magnesium, aluminum, titanium, and alloys thereof, and wherein the substrate is chosen from aluminum, zinc, magnesium, titanium, copper, steel, and alloys thereof.

6. The method as defined in claim 1 wherein after forming the oxide layer, the method further comprises providing a source of oxygen by extracting the oxygen i) from the oxide layer formed on the substrate surface, or ii) from air within an ambient environment, or iii) from both i) and ii).

7. The method as defined in claim 1 wherein the forming of the oxide layer is accomplished naturally, by depositing the oxide layer on the substrate, or by growing the oxide layer from the substrate via anodization in the presence of an electrolyte.

8. The method as defined in claim 1 wherein prior to forming the other oxide, the method further comprises patterning the substrate surface.

9. The method as defined in claim 1 wherein the other oxide is a binary oxide, a ternary oxide, an oxide having an order higher than ternary, a spinel, or combinations thereof.

10. The method as defined in claim 1, further comprising applying heat at least to the interface between the over-cast metal and the oxide layer to further the other oxide-forming reaction.

11. A method of bonding magnesium to an aluminum substrate, comprising:
forming an alumina layer on a surface of the aluminum substrate; and in a molten state, over-casting the magnesium onto the aluminum substrate, the over-casting driving a reaction at an interface between the magnesium and the alumina layer in the presence of oxygen to form a spinel, wherein the spinel binds the magnesium to the aluminum substrate upon solidification of the magnesium;

wherein the alumina layer includes a plurality of nanopores defined therein.

12. The method as defined in claim 11 wherein the magnesium reacts with the oxygen molecules i) from the alumina layer formed on the substrate surface, or ii) from a gas to form the spinel, or iii) from both i) and ii).

13. The method as defined in claim 11 wherein the magnesium reacts with the alumina layer of the substrate surface alone to form the spinel.

14. The method as defined in claim 11 wherein the magnesium reacts with oxygen molecules from a material introduced into the plurality of nanopores, the material being chosen from a reducible metal oxide.

* * * * *